US008419317B2

(12) United States Patent
Irvine et al.

(10) Patent No.: US 8,419,317 B2
(45) Date of Patent: Apr. 16, 2013

(54) SYSTEM AND METHOD FOR INSTALLING SHEET PILES

(75) Inventors: John E. Irvine, Atlanta, GA (US); Steven E. Hargrave, Roswell, GA (US); Charles B. Brown, Atlanta, GA (US)

(73) Assignee: CMI Limited Company, Atlanta, GA (US)

( * ) Notice: Subject to any disclaimer, the term of this patent is extended or adjusted under 35 U.S.C. 154(b) by 136 days.

(21) Appl. No.: 12/778,545

(22) Filed: May 12, 2010

(65) Prior Publication Data

US 2010/0290843 A1 Nov. 18, 2010

Related U.S. Application Data

(60) Provisional application No. 61/177,536, filed on May 12, 2009, provisional application No. 61/225,444, filed on Jul. 14, 2009.

(51) Int. Cl.
*E02D 5/16* (2006.01)

(52) U.S. Cl.
USPC ..... 405/274; 405/272

(58) Field of Classification Search ..... 405/272, 405/274, 276, 277, 278, 281
See application file for complete search history.

(56) References Cited

U.S. PATENT DOCUMENTS

| | | | | |
|---|---|---|---|---|
| 3,333,431 | A * | 8/1967 | Dougherty | 405/278 |
| 3,822,557 | A * | 7/1974 | Frederick | 405/278 |
| 3,889,482 | A * | 6/1975 | Frederick | 405/274 |
| 4,028,901 | A * | 6/1977 | Barber | 405/277 |
| 5,503,503 | A | 4/1996 | Glass et al. | |
| 5,803,672 | A | 9/1998 | Glass et al. | |
| 6,231,271 | B1 | 5/2001 | Glass et al. | |
| 6,568,881 | B2 * | 5/2003 | Long | 405/248 |
| 6,726,864 | B2 | 4/2004 | Nasr et al. | |
| 7,056,066 | B2 * | 6/2006 | Irvine | 405/274 |
| 7,470,093 | B2 | 12/2008 | Mansfield | |
| 7,628,570 | B2 | 12/2009 | Davidsaver et al. | |
| 7,914,237 | B2 * | 3/2011 | Glass et al. | 405/274 |
| 2003/0034338 | A1 * | 2/2003 | Moulin et al. | 405/276 |
| 2005/0053429 | A1 | 3/2005 | Davidsaver et al. | |
| 2007/0039265 | A1 | 2/2007 | Arcand et al. | |
| 2007/0065235 | A1 | 3/2007 | Glass et al. | |
| 2007/0137128 | A1 | 6/2007 | Viau et al. | |
| 2007/0175150 | A1 | 8/2007 | Price | |
| 2007/0175159 | A1 | 8/2007 | Miniter | |
| 2010/0074698 | A1 * | 3/2010 | Jinnings et al. | 405/276 |
| 2010/0263892 | A1 * | 10/2010 | Jinnings et al. | 405/274 |

FOREIGN PATENT DOCUMENTS

| | | | |
|---|---|---|---|
| JP | 56039243 | A * | 4/1981 |
| JP | 56142927 | A * | 11/1981 |

* cited by examiner

*Primary Examiner* — Frederick L Lagman
(74) *Attorney, Agent, or Firm* — Gardner Groff Greenwald & Villanueva, PC

(57) ABSTRACT

A system for installation of sheet pile including a sheet pile installation apparatus having a substantially rigid elongate beam with an upper end and a lower end, and at least one drive finger proximal the lower end of the substantially rigid elongate beam; and a sheet pile having an elongate member with an upper end and a lower end, and a first side and a second side, the first side having a male profile lock and the second side having a female profile lock, the sheet pile further including at least one receiver proximal the lower end for receiving the at least one drive finger of the sheet pile installation apparatus.

24 Claims, 19 Drawing Sheets

SYSTEM AND METHOD FOR INSTALLING SHEET PILES

CROSS-REFERENCE TO RELATED APPLICATION

This application claims priority benefit to U.S. Provisional Patent Application Ser. No. 61/177,536 filed May 12, 2009 and U.S. Provisional Patent Application Ser. No. 61/225,444 filed Jul. 14, 2009, which are hereby incorporated herein by reference.

TECHNICAL FIELD

The present disclosure relates generally to methods and apparatuses for use in forming driven wall structures constructed of structural panels such as sea walls, retaining walls, dikes, barrier walls and the like. More specifically, the present disclosure relates to a sheet pile system and a sheet pile installation apparatus for inserting sheet piles vertically into soil formations, and methods of use thereof.

BACKGROUND

Barrier walls that are formed from a plurality of elongated, vertically oriented piles typically are driven into the earth to a depth sufficient to support the piles in an upright attitude. In some cases, the piles are formed with male and female opposed edges so that similar sheet piles can be locked together at their adjacent side edges to form a continuous barrier or "cutoff" wall for blocking water transport across the wall. Because of the strength required of the sheet piles when being driven into the earth and the strength required under load conditions, the sheet piles have typically been made of steel or aluminum. Frequently, steel and aluminum sheet piles have over-sized cross sections to allow for the effects of corrosion. The additional material used in "over-sizing" increases the costs of the sheet piles due to the material itself, as well as the costs associated with handling the heavier piles.

In recent years, sheet piles have been constructed of polyvinyl chloride and other plastics having relatively low structural strength. The sheet piles are extruded in a continuous manufacturing process. In order to provide the strengths in the sheet piles necessary to withstand the loads that are expected to be applied to the sheet piles, such as while being driven vertically into the earth, the thicknesses of the sheet piles have been increased over the typical thickness of similar sheet piles formed of steel or aluminum. Further increases in the thickness of the plastic provides a diminishing return. The increased bending strength does not offset the cost of the additional plastic.

In order to produce sheet piles formed of a synthetic material that are to be used as driven piles in the formation of a barrier wall, the sheet piles have often been formed in various strengthening cross-sectional shapes, such as V-shapes, Z-shapes, U-shapes, etc., that provide resistance to bending in response to the application of axial and/or lateral loads to the sheet piles. Further, the panels have been constructed so as to have at their opposite edges male and female locking elements, so that the edge of one pile locks with and supports the edge of an adjacent pile.

After the first sheet piles have been driven into place, subsequent sheet piles can be driven into place adjacent the previously driven sheet piles with their male and female edges locked together as they are driven, thereby forming a continuous barrier wall. The barrier wall typically is held in place with a series of horizontally placed structural members, or wales, that extend along the exposed outer surface of the barrier wall. The wales frequently are held in place with a plurality of tie rods. The tie rods extend through the wale, the barrier wall, and the soil disposed behind the barrier wall, and have one end secured to the wale and another end which is secured to a force abutter. Typically, the force abutter is a reinforced cement wall disposed a desired distance behind the barrier wall such that adequate force is exerted from the force abutter through the tie rods on the barrier wall, thereby maintaining the barrier wall in the desired position.

As previously noted, although measures can be taken to increase the ability of extruded plastic sheet piles to withstand the large axial loads applied during driving operations, it is not uncommon to damage sheet piles during driving operations. Miscalculations and/or misjudgments related to the required thickness of the sheet piles, or simple over application of driving force, can cause the sheet piles to be damaged. Removal and replacement of the damaged sheet piles is costly in both time and materials.

As well, warpage, twisting, deflection, etc., of a structural panel during driving operations can cause the male and female locked edges to separate between adjacent sheet piles. If the separation is detected, once again, the sheet pile must be removed and re-driven or replaced. If the separation goes undetected, the structural integrity of the barrier wall can be severely compromised. This is especially harmful where the barrier wall is being used to prevent the spread of potentially harmful liquids, such as when used on industrial facilities, around garbage dumps, during the clean up of polluted areas, etc.

U.S. Pat. No. 7,056,066 discloses an apparatus and method for inserting sheet piles into a soil formation. U.S. Pat. No. 7,056,066 is incorporated herein by reference in its entirety.

It is to the provision of an improved sheet pile and installation apparatus and related methods that the present invention is primarily directed.

SUMMARY OF THE INVENTION

In example embodiments, the present invention relates to an improved system and method for installing sheet piles and/or other elongate barrier components into a soil formation, as well as an improved sheet pile installation apparatus and an improved sheet pile for use in connection therewith. The system and method provide a positive engagement with the lower end of the sheet piling or other component to more effectively pull the sheet piling into the ground. By directly engaging and pulling the piling from the end that is inserted into the ground, rather than pushing the piling into the ground, warping or other deformation of the piling during installation is minimized or eliminated. Example embodiments of the system and method optionally incorporate various forms of protective toe members to shield the leading edge of the sheet piling during installation, a grout tube for delivery of a sealing compound along the seam between adjacent piling members, and/or a tandem or plural pile installation system and method.

In one aspect, the present invention relates to an installation apparatus including a substantially rigid elongate beam having an upper end and a lower end, and at least one drive finger or other form of engagement element proximal the lower end of the substantially rigid elongate beam for releasable engagement with a cooperating receiver of a sheet pile or other elongate component.

In another aspect, the invention relates to a sheet pile comprising an elongate member having an upper end and a lower end, and a first side and a second side, the first side comprising a first interengaging profile interlock element and the second side comprising a second interengaging profile interlock element for coupling with the first interengaging profile interlock element, the sheet pile further comprising at least one receiver proximal the lower end for receiving a cooperating engagement element of a sheet pile installation apparatus.

In still another aspect, the invention relates to a system for installation of sheet pile or other elongate component including an installation apparatus having a substantially rigid elongate beam with an upper end and a lower end, and at least one engagement element proximal the lower end of the substantially rigid elongate beam; and a sheet pile or other barrier component having an elongate body with an upper end and a lower end, and a first side and a second side, the first side having a first interengaging profile interlock element and the second side having a second interengaging profile interlock element for coupling with the first interengaging profile interlock element, the elongate component further including at least one receiver proximal its lower end for receiving the at least one engagement element of the installation apparatus.

In another embodiment, the invention relates to an installation system and method, sheet piling and installation apparatus, wherein the sheet piling has a hooked receiver at its lower end for receiving the engagement element of the lower end of the installation apparatus.

In another embodiment, the invention relates to sheet piling having a substantially flat transverse profile along at least a portion of its length, and a hooked receiver at its lower end for receiving the engagement element of the lower end of the installation apparatus.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
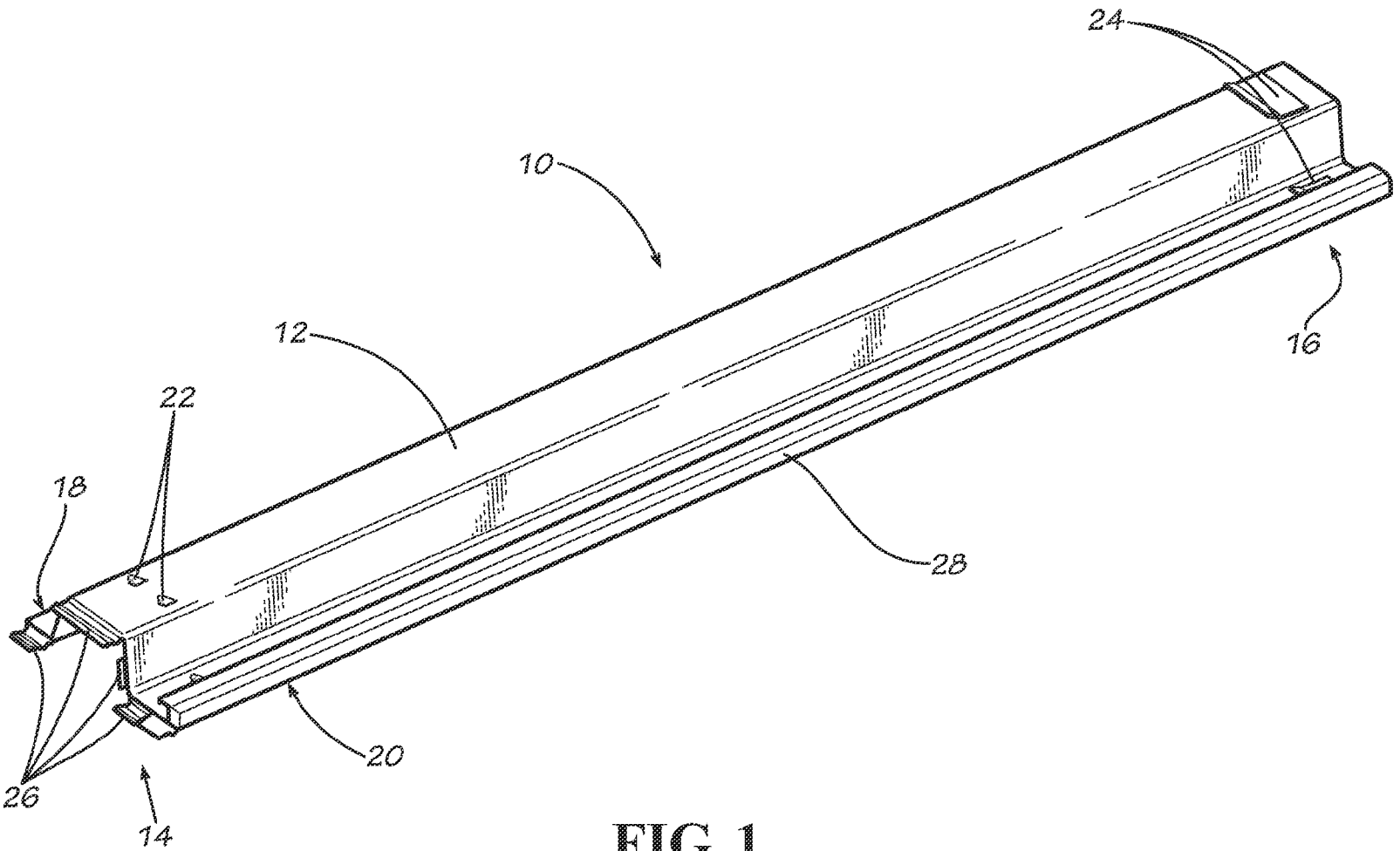
FIG. 1 is a perspective view of a sheet pile installation apparatus according to an example embodiment of the present invention.

With reference now to the drawing figures, wherein like reference numbers represent corresponding parts throughout the several views, FIG. 1 shows a sheet pile installation apparatus or mandrel 10 according to an example form of the invention. The apparatus 10 generally comprises a substantially rigid column or beam 12 having a length selected to correspond to a desired depth of the installation of the sheet piling to be installed. The beam 12 preferably has a cross-sectional profile adapted to generally match and receive the profile of the sheet piling to be installed. The beam 12 optionally further includes one or more structural stiffening members such as, for example, an I-beam extending along at least a portion of its length. A first or lower end 14 is adapted for insertion into the ground during installation of the sheet piling, and a second or upper end 16 is adapted for engagement with a crane-carried drive mechanism, or other form of drive mechanism, for applying downward force to drive the apparatus 10 to the desired depth into the ground during the installation process. A first lateral side 18 and a second lateral side 20 of the beam 12 are shaped to generally conform with the first and second side profiles, respectively, of the sheet piling.

The installation apparatus 10 preferably includes one or more pegs, drive fingers or other form of engagement elements 22 proximal the first or lower end 14, for releasably engaging a sheet pile component during the installation process. The installation apparatus 10 optionally also includes one or more clips or engagement members 24 proximal the second or upper end 16 for engaging the sheet pile component. The installation apparatus 10 optionally also includes one or more toe shield members 26 at the first or lower end 14, as described in greater detail below. The installation apparatus 10 also optionally includes a grout or sealant delivery conduit or tube 28 extending at least partially along its length, as will be described in greater detail below. Optionally, the installation apparatus includes an augur bit or wheel (not shown) adjacent its lower end to assist in cutting through rock or hard soils upon installation.

Figure 2:
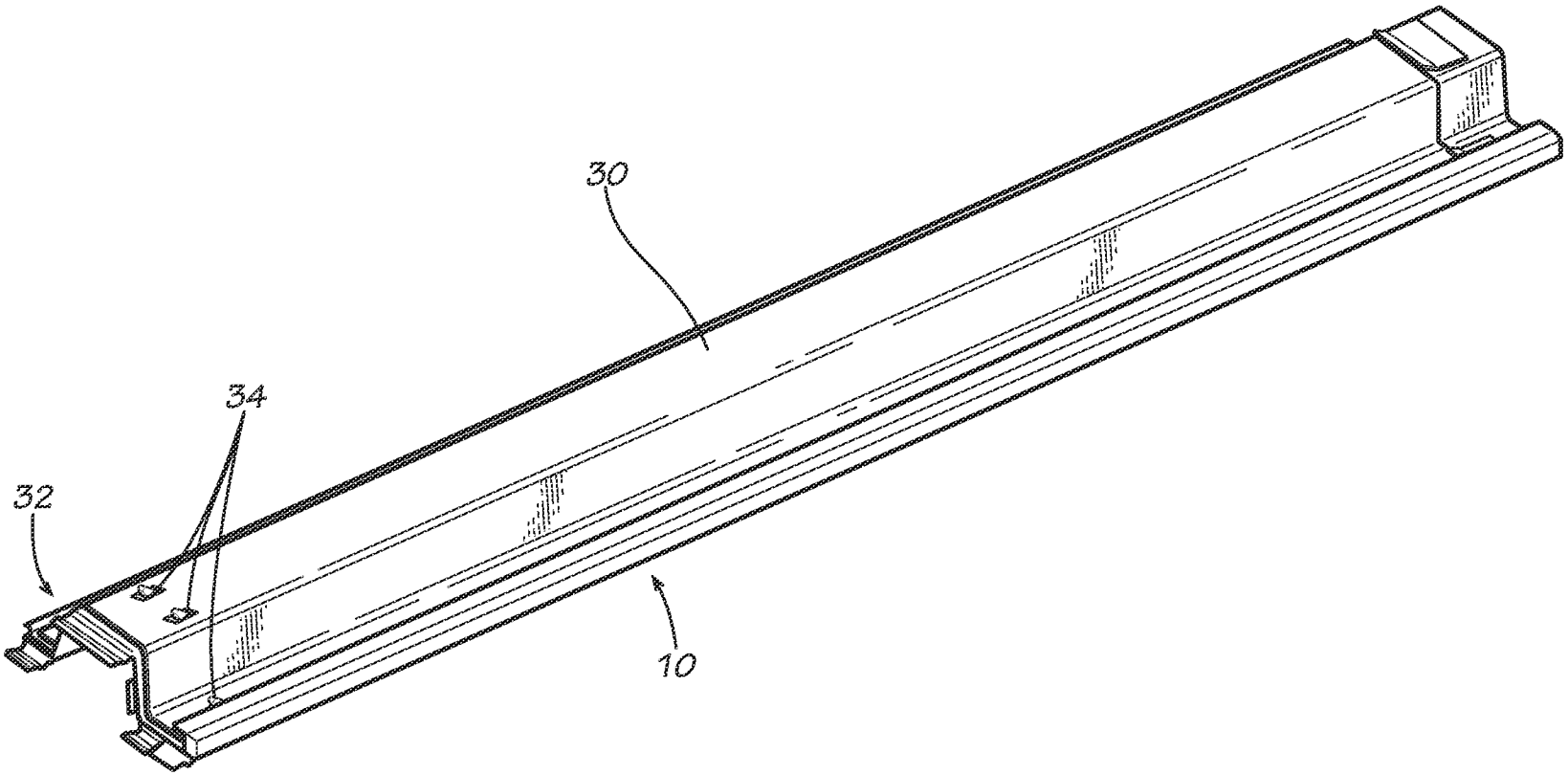
FIG. 2 is a perspective view of the sheet pile installation apparatus of FIG. 1, having a sheet pile member carried thereon.

FIG. 2 shows the installation apparatus 10 having a sheet pile component 30 carried thereon, according to an example form of the invention. The sheet pile component 30 can be formed of various materials, including without limitation, polyvinyl chloride (PVC), high-density polyethylene (HDPE) or other plastics, fiberglass, composite, aluminum, steel or other metals, ceramics, and/or other materials. The sheet pile component 30 can be formed to have a variety of cross-sectional profiles, for example, a C-shaped, S-shaped, V-shaped, flat, corrugated, or other profile configuration. A first end 32 of the sheet pile component of the present invention includes at least one, and optionally a plurality of receivers 34 formed therein for releasably receiving engagement elements 22 of the installation apparatus. In example embodiments, the receivers 34 comprise four laterally-spaced openings extending entirely through the thickness of the sheet pile component 30. In alternate embodiments, the receivers 34 can comprise one or more recesses, ridges, projections, hooks, or other surface features for releasable engagement with one or more cooperating engagement elements of the installation apparatus. The sheet pile component 30 preferably includes a male lock profile 36 along a first edge thereof and a cooperating female lock profile 38 along a second edge thereof (as better seen in FIG. 6). The male and female locks can take the form of any first and second inter-engaging profiles, including identical profiles having cooperatively self-engaging features, and are not limited to convex and concave shape profiles. While the depicted embodiment incorporates interengaging male and female interlock profiles, the invention also includes various other interengaging first and second profile interlock elements for coupling adjacent barrier members to one another, including without limitation: interlocking female interlock profiles, opposed S-shaped or otherwise rolled or hooked interlock profiles, double male interlock profiles forming a channel therebetween for engaging a male profile of an adjacent member, as well as any other interengaging first and second interlock profiles.

Figure 3:
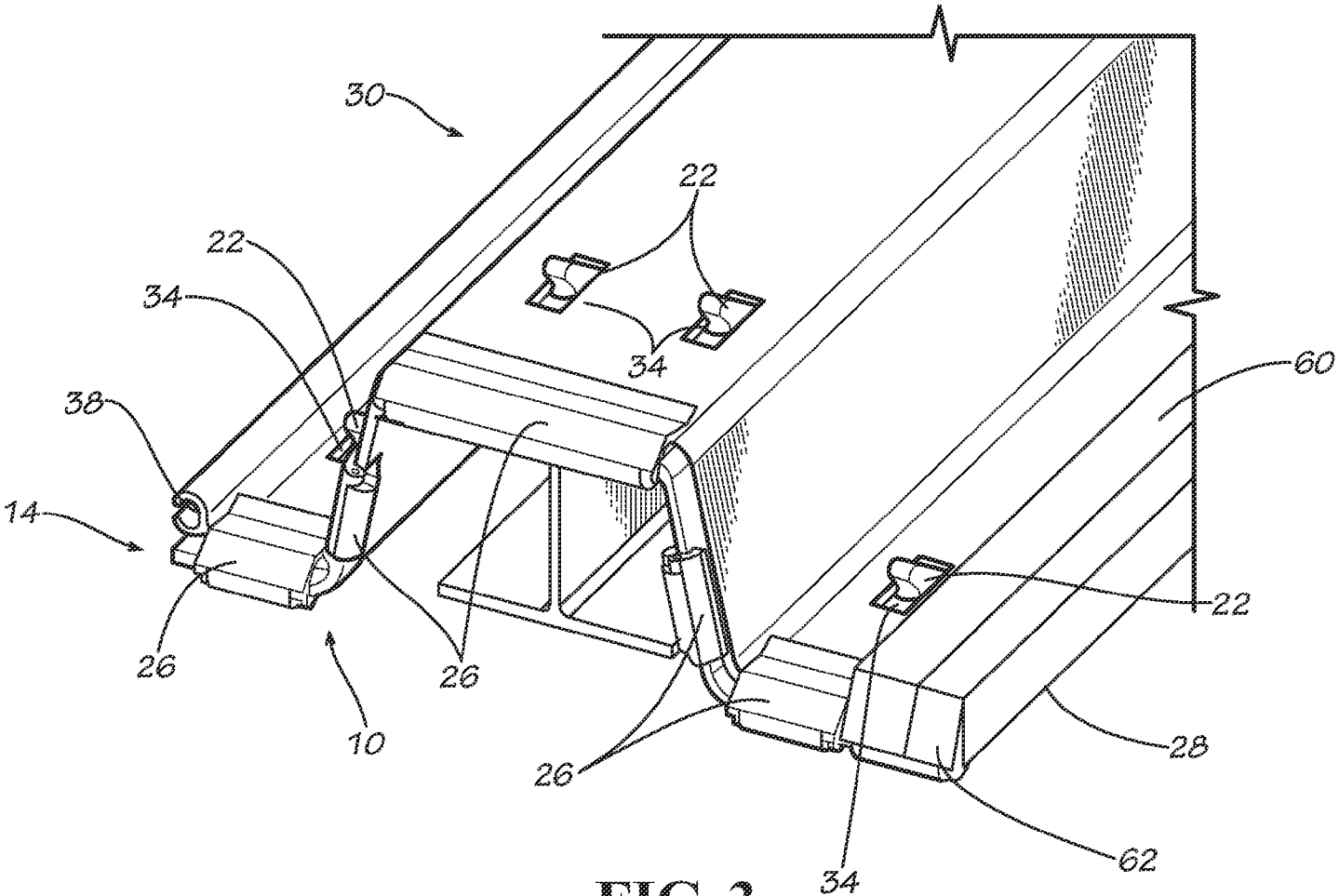
FIG. 3 is a detailed perspective view of a leading edge portion of a sheet pile installation apparatus according to an example form, showing a grout delivery tube and leading edge protection members in a closed state.
Figure 4:
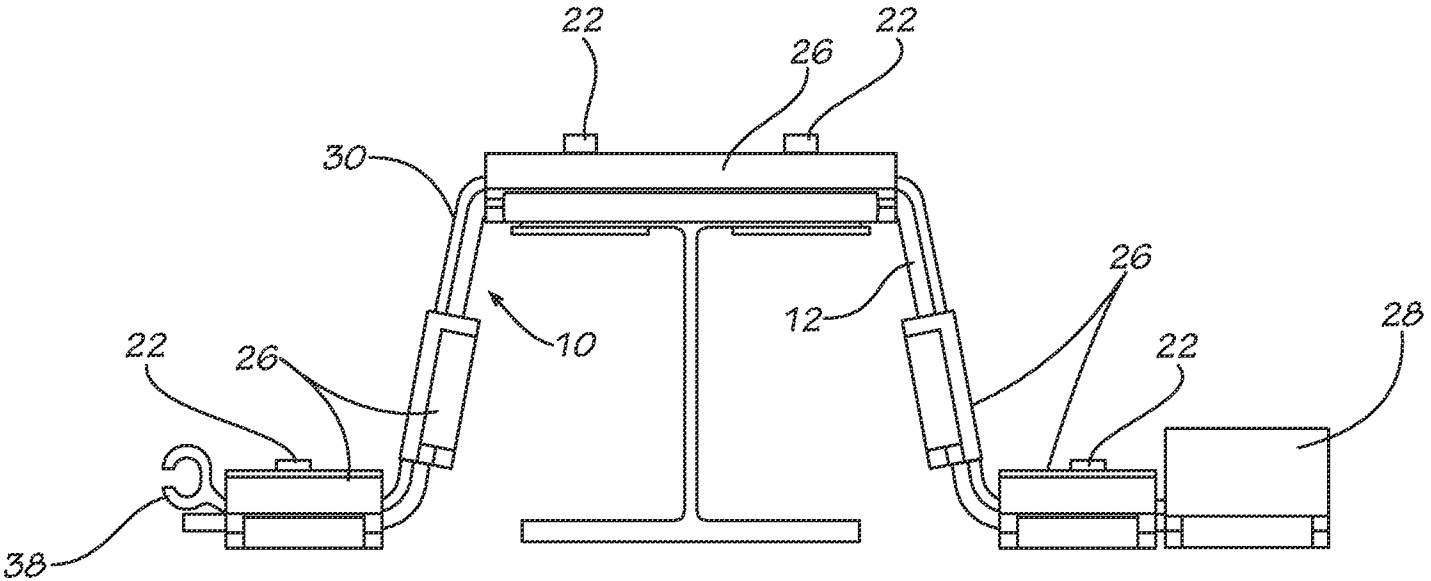
FIG. 4 is a detailed end view of the leading edge portion of a sheet pile installation apparatus, showing the grout delivery tube and leading edge protection members in a closed state.

FIGS. 3 and 4 show the lower end 14 of the installation apparatus 10 and sheet pile 30 of the present invention in greater detail. The engagement elements 22 of the installation apparatus 10 preferably include a recess or concave lower engagement face directed toward the lower end 14 of the installation apparatus for abutment against the sheet pile 30 during installation, and an inclined upper contact face sloping downward and away from the beam 12 of the installation apparatus for separation of the installation apparatus from the sheet pile during removal of the installation apparatus after installation of the sheet pile. The engagement elements 22 can be rigidly fixed to the beam 12, or can be pivotally mounted to the beam to retract during removal of the installation apparatus. In example embodiments, the drive fingers are actuated to retract and release the sheet pile upon contact of an actuator portion of the installation apparatus with the soil upon retraction of the installation apparatus. In other embodiments, the engagement elements are pneumatically, hydraulically or otherwise actuated to selectively advance into engagement with the sheet pile and/or to release the sheet pile, whereby contact with the soil does not actuate a release of the sheet pile from the installation apparatus upon retraction, thereby enabling the installation apparatus to be used both to install and to remove the sheet pile.

The toe shield member(s) 26 comprise one or more pivotally mounted flanges attached to the beam 12 by a hinged connection. Each toe shield member 26 preferably comprises an angularly offset profile providing a spacing adjacent the hinge approximately equal to the thickness of the sheet pile 30, when pivoted into contact with the sheet pile, so as not to apply an upward force onto the sheet pile when the toe shield member presses against the sheet pile during the installation process. Each toe shield member preferably also comprises an outwardly inclined exterior contact face for impingement against the soil during the installation process, causing the toe shield member to be pressed against the sheet pile 30, applying pressure and maintaining frictional engagement between the sheet pile and the installation apparatus. Preferably, a toe shield member 26 is provided along each segment or web of the installation apparatus for protecting the leading edge of each corresponding segment or web of the sheet pile 30 from damage due to contact with soil and/or rocks during installation. In an alternate embodiment, the toe shield member has a thinner, wedge-shaped profile that does not wrap around and over the leading edge of the sheet pile, but only shields the leading edge from contact with the soil during installation. Although this embodiment does not apply pressure on the sheet pile against the installation apparatus to assist in pulling the sheet pile into the ground, its lower profile may result in less energy required to drive a sheet pile into the ground.

Figure 5:
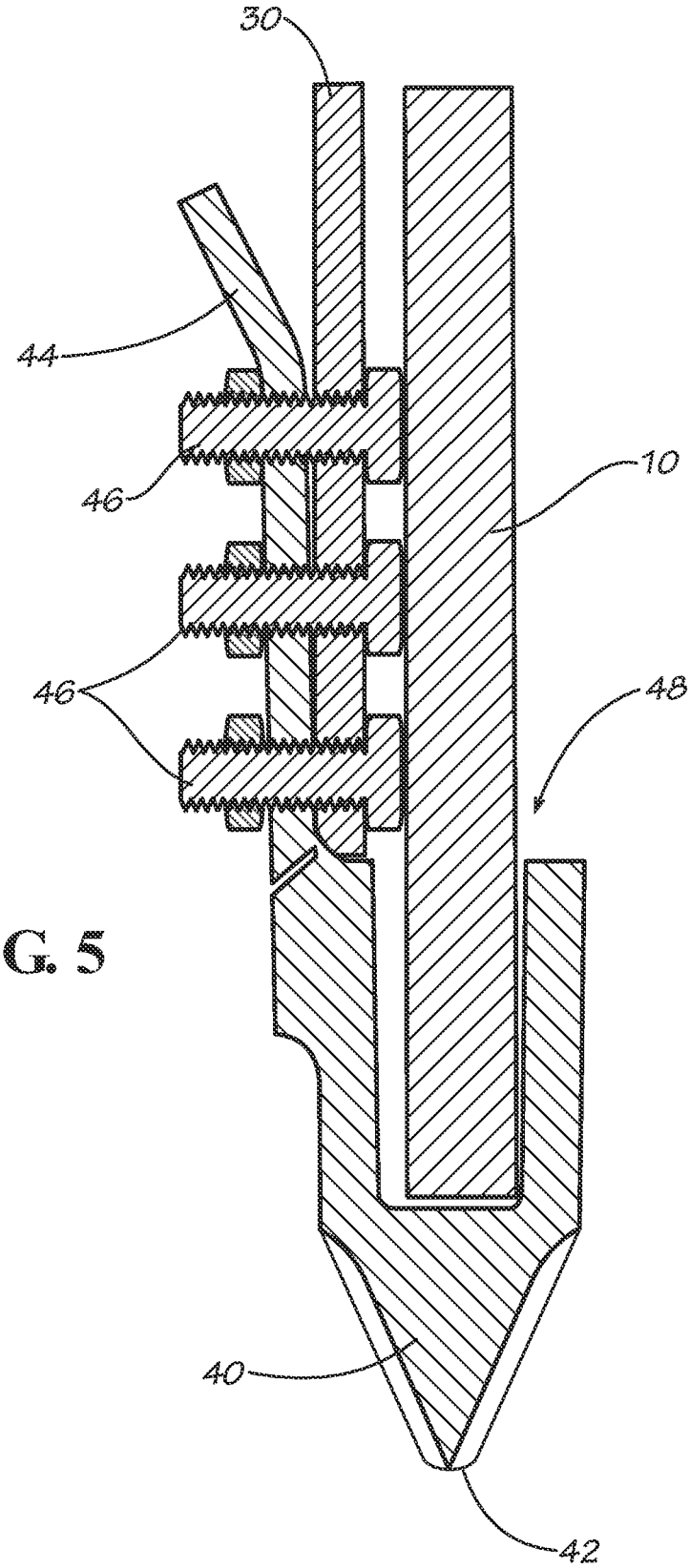
FIG. 5 is a detailed end view of another embodiment of a leading edge protection portion of a sheet pile installation apparatus.

FIG. 5 shows another embodiment of a toe clip or toe shield member 40. The toe shield member 40 comprises a body having a pointed leading edge 42, a flange 44 for attachment to the sheet pile 30 by one or more bolts 46 or other coupling means, and a channel 48 for receiving the lower end of the installation apparatus 10 during installation. An outwardly angled or flared top edge of the flange 44 digs into the soil when the installation apparatus is retracted, to prevent the sheet pile from pulling out of the ground along with the installation apparatus. The installation apparatus 10 engages within the channel 48 to pull the sheet pile 30 into the soil, and the toe shield member remains buried in the soil after retraction of the installation apparatus, and is therefore termed a "sacrificial" toe shield or toe clip.

Figure 6:
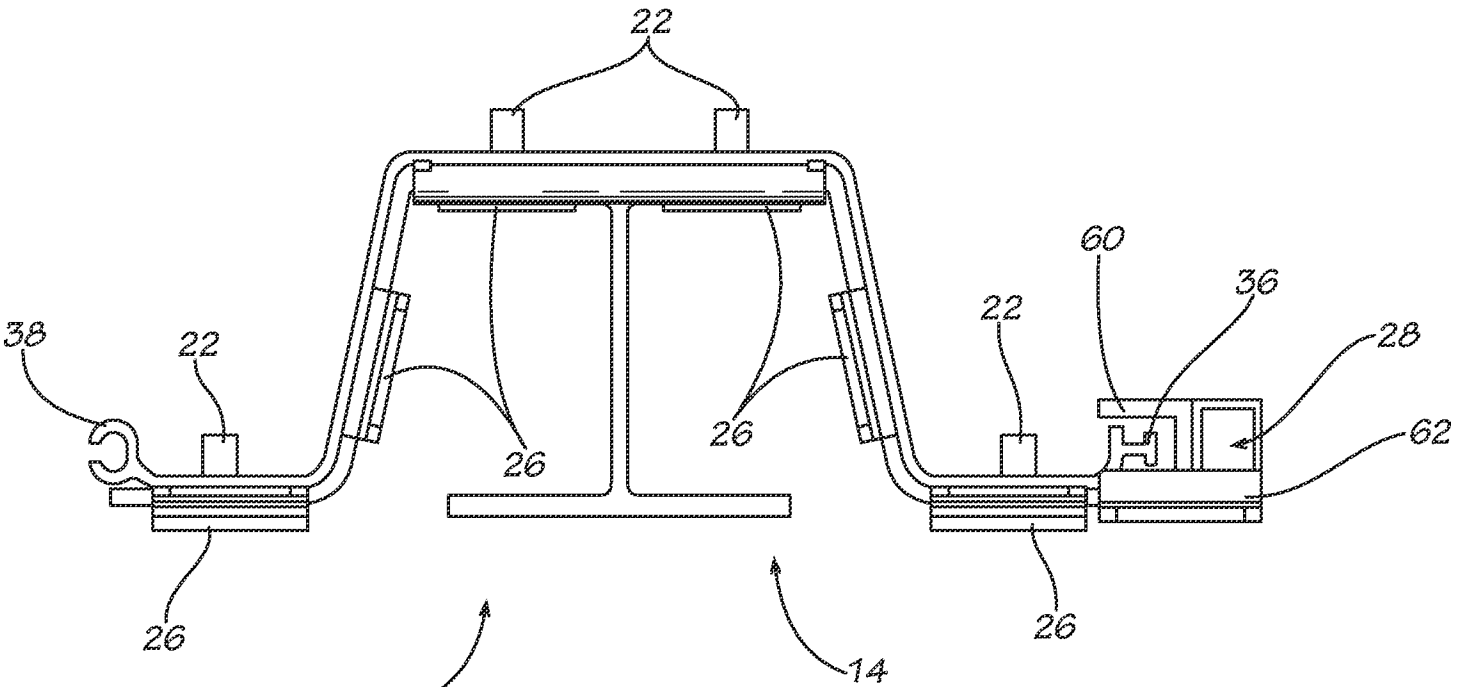
FIG. 6 is a detailed end view of the sheet pile installation apparatus of FIG. 1, showing the grout delivery tube and leading edge protection members in an open state.
Figure 7:
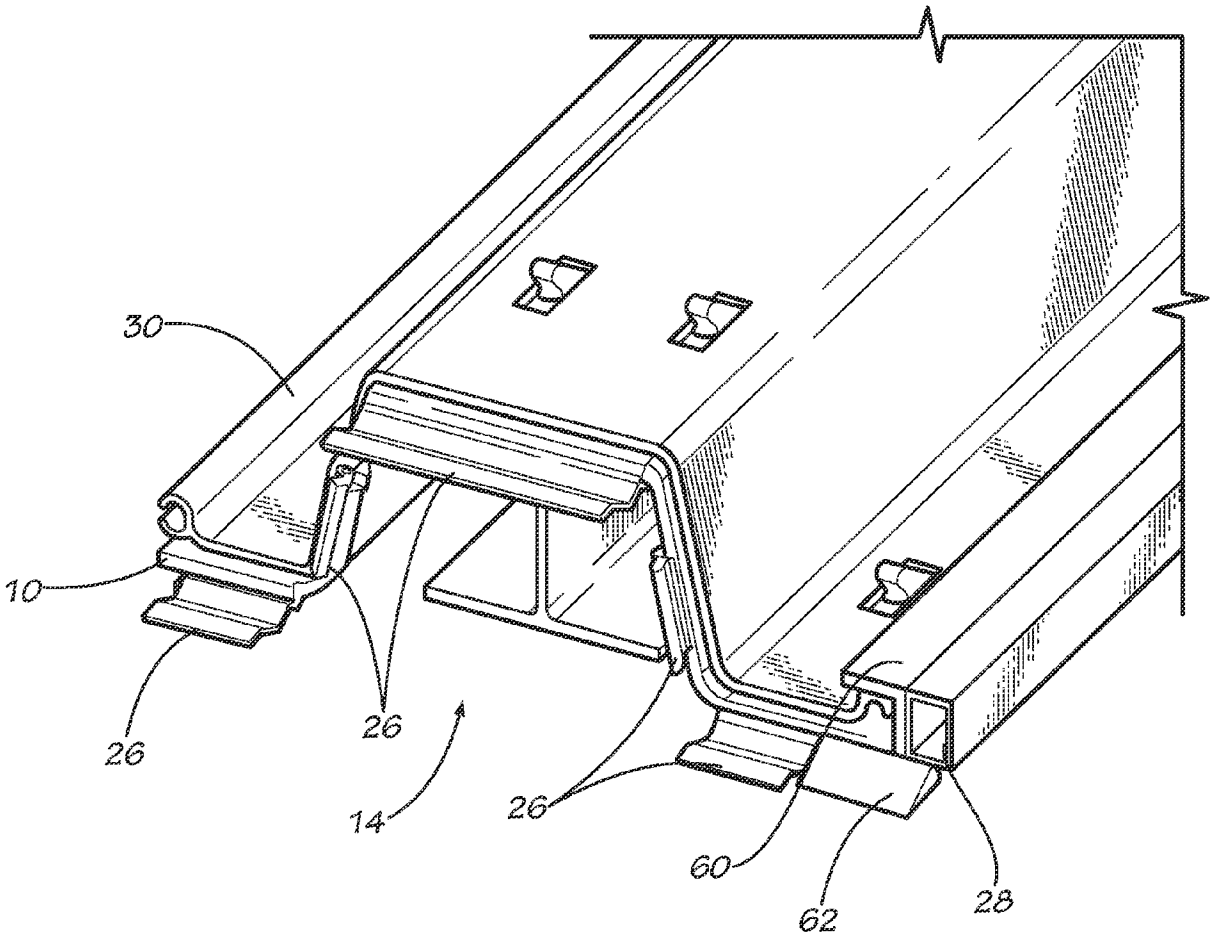
FIG. 7 is a detailed perspective view of the sheet pile installation apparatus of FIG. 1, showing the grout delivery tube and leading edge protection members in an open state.

FIGS. 6 and 7 show the lower end 14 of the installation apparatus 10 and sheet pile 30 of the present invention in greater detail, with the toe shield members 26 pivoted into their open positions. The installation apparatus 10 optionally further includes a male lock protector 60 for protecting the leading edge of the male lock profile portion 36 of the sheet piling 30 as it is being driven into the soil. The male lock protector 60 comprises a substantially rigid protective flange extending inwardly over the second lateral side of the installation apparatus 10 along at least a portion of its length, and optionally along its entire length. A pivotally mounted end cover 62 is optionally provided at the lower end 14 to shield the leading edge of the male lock profile portion 36 as it is driven into the ground, and to prevent application of upward force by the soil on the bottom or toe end of the sheet pile as the installation apparatus is driven into the ground.

The installation apparatus 10 optionally also includes a sealant or grout delivery tube 28 comprising a hollow conduit or channel for delivering grout or sealant from an external source along the seam between two adjacent sheet pile components to cut off water migration through the seam, as shown in FIGS. 6 and 7. The lower end of the grout delivery tube comprises an opening for releasing the grout or sealant. Optionally, a pivotal closure member is provided to close the open end during installation to prevent soil entry. In the depicted embodiment, the pivotally mounted end cover 62 of the male lock protector 60 serves as the closure member.

In an example manner of use, the installation apparatus is driven into the ground and a sheet pile carried thereon is pulled from its toe end into the ground to the desired depth, and as the installation apparatus is retracted leaving the sheet pile in place, grout is pumped through the tube 28 to leave a column of grout in the soil along the male lock profile of the sheet pile. Upon subsequent installation of the next adjacent sheet pile member, the female lock member engages along its length with the male lock member of the previously installed sheet pile member, with the seam between the sheet pile members being embedded within the previously placed column of grout, thereby sealing the seam between the sheet pile members. In alternate embodiments, one or more grout delivery conduits are positioned on the installation apparatus to deliver grout along one or more portions of the sheet pile, or along substantially the entire back face of the sheet pile, along the entire length of the sheet pile or a portion thereof, as the installation apparatus is removed.

Figure 8:
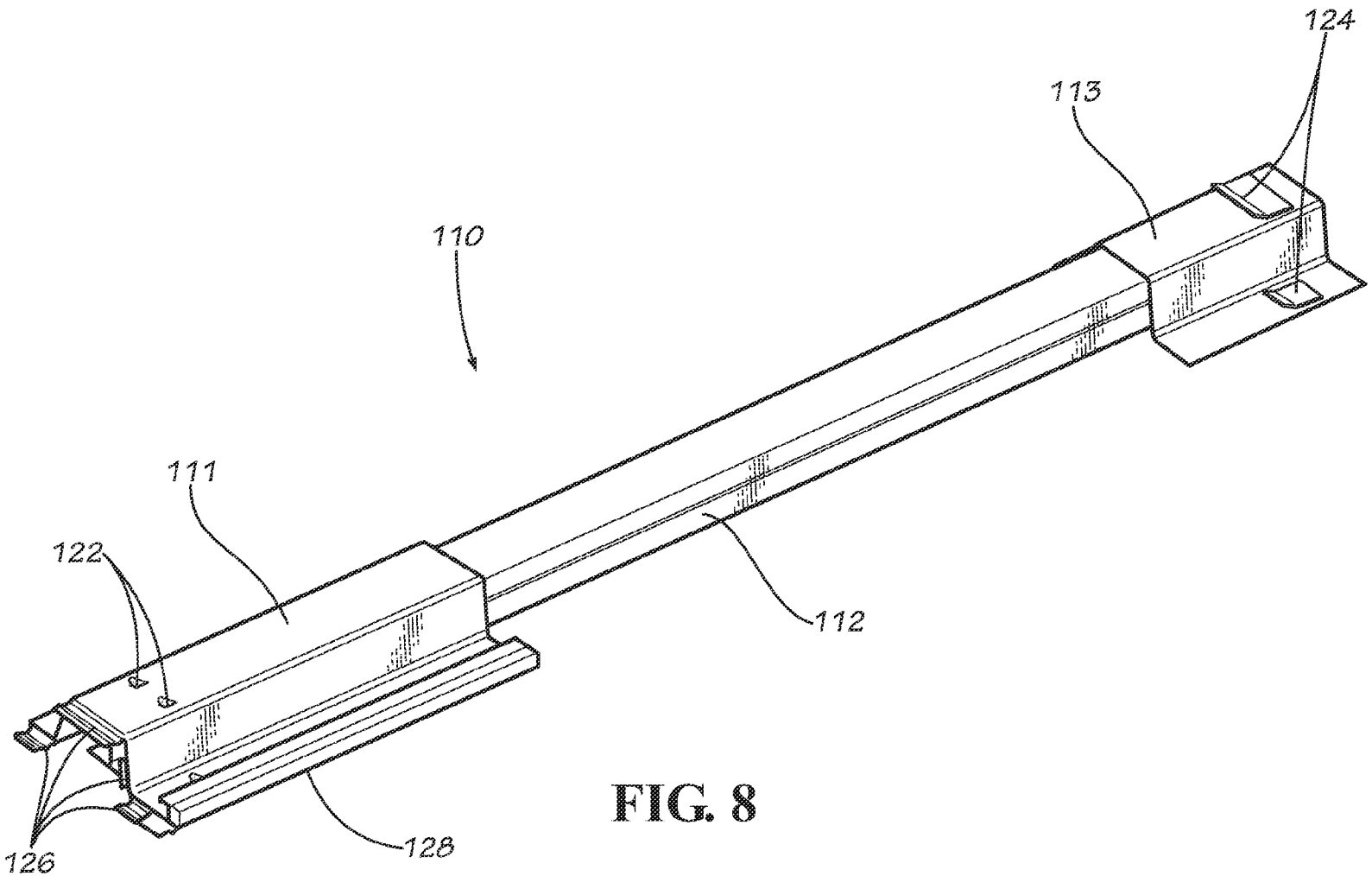
FIG. 8 is a perspective view of a sheet pile installation apparatus according to another example form of the invention.
Figure 9:
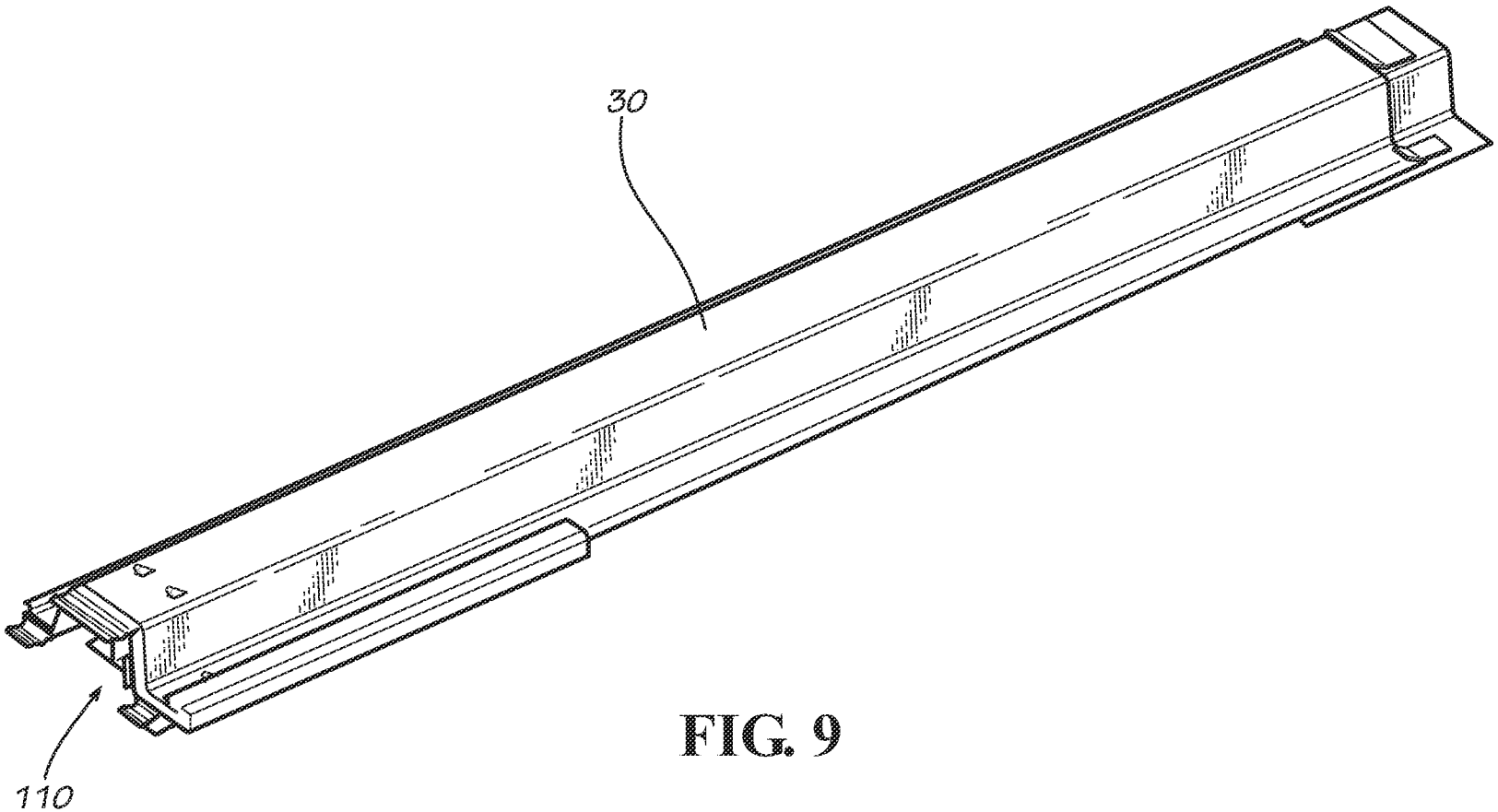
FIG. 9 is a perspective view of the sheet pile installation apparatus of FIG. 8, having a sheet pile member carried thereon.

FIGS. 8 and 9 show an alternate embodiment of an installation apparatus 110 for installing sheet pile 30. A lower profile member 111 is affixed at a first or lower end of a beam or column 112, and an upper profile member 113 is affixed at a second or upper end of the beam or column. The remainder of the features of the installation apparatus 110 are substantially similar to the corresponding features of the above-described installation apparatus 10. Provision of the split lower and upper profile members allows control of the contact surface area between the profile members and the sheet pile, thereby controlling the frictional engagement force therebetween. Additional frictional engagement between the installation member and the sheet pile helps during the insertion phase of installation, as it increases the pulling force applied by the installation member on the sheet pile as it is driven into the ground. But additional frictional engagement hurts during the retraction phase of installation as it makes removal of the installation member from the sheet pile, which remains in the ground, more difficult. Depending upon the type of soil and other conditions encountered, the user may select profile members of differing lengths to control the surface area of contact, and thereby vary the degree of frictional engagement, between the installation member and the sheet pile.

Figure 10:
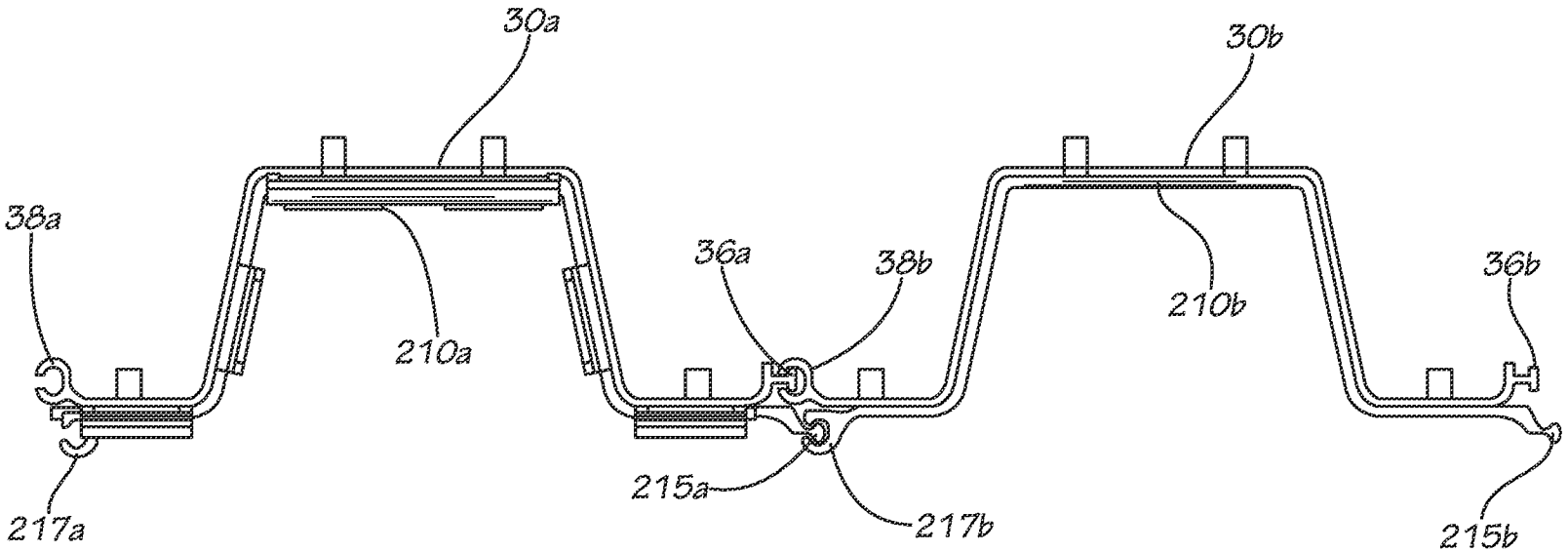
FIG. 10 is a detailed end view of a tandem or dual sheet pile installation system and sheet pile according to an example form of the present invention.
Figure 11:
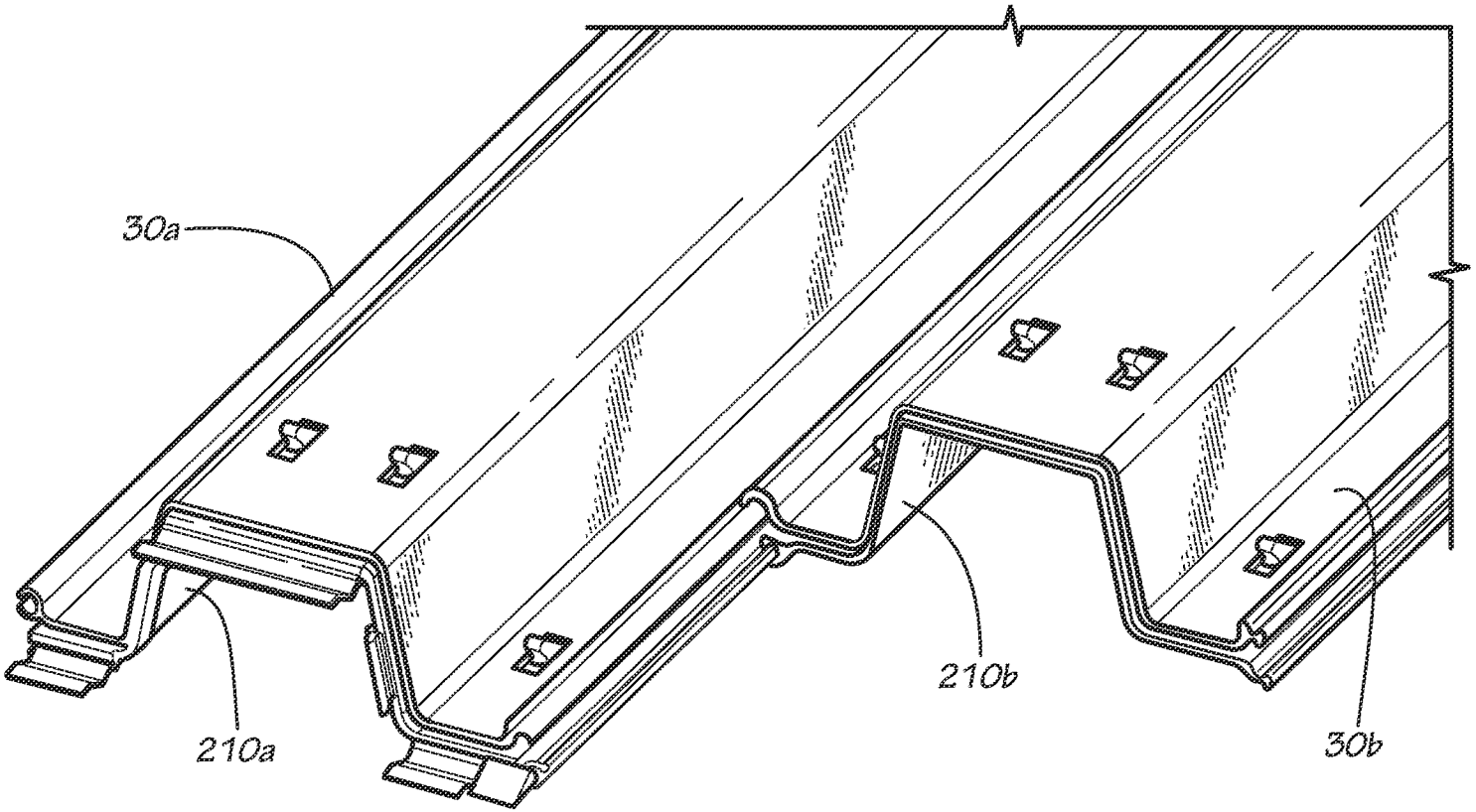
FIG. 11 is a detailed perspective view of the sheet pile installation system of FIG. 10.
Figure 12:
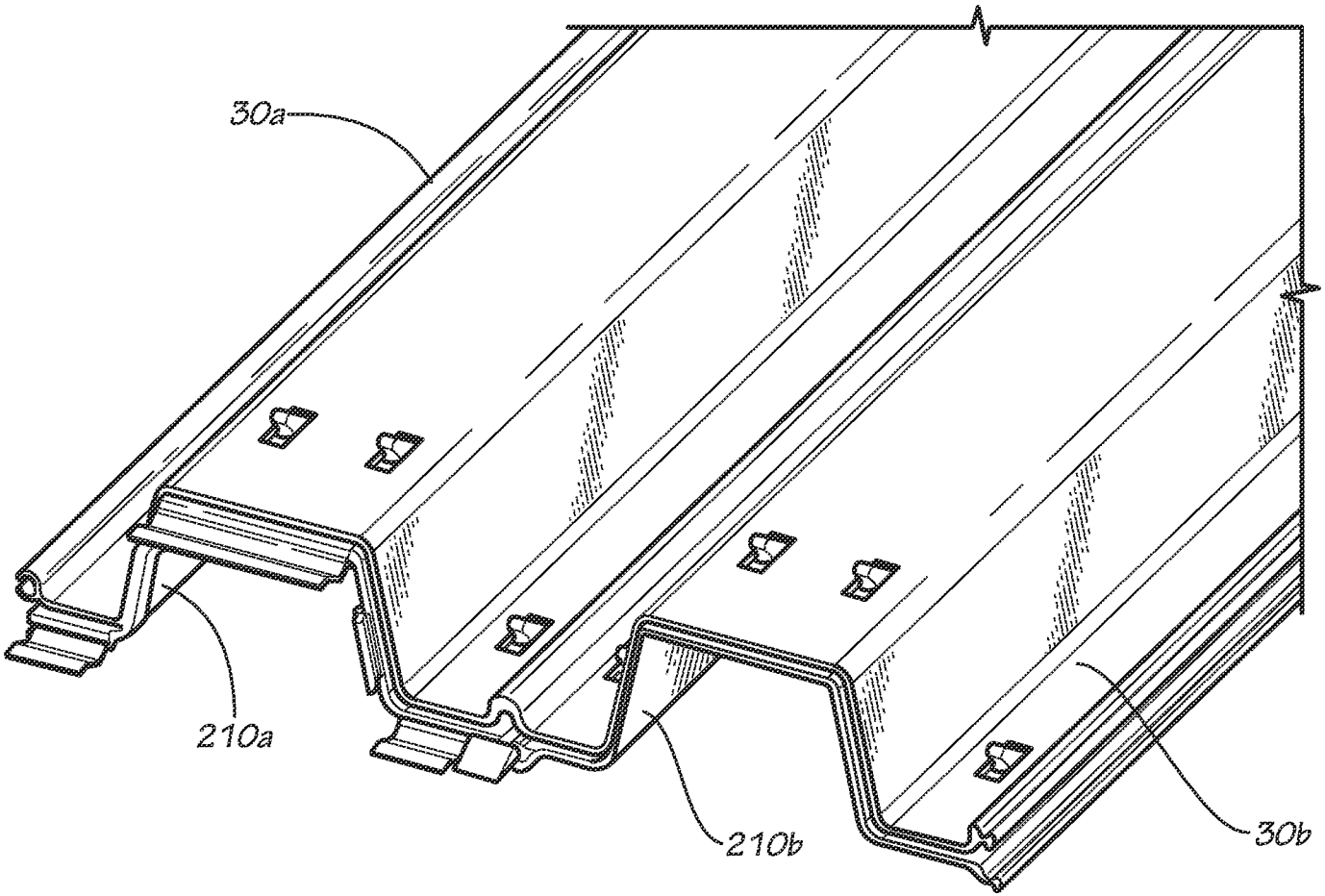
FIG. 12 is another detailed perspective view of the sheet pile installation system of FIG. 10.

FIGS. 10-12 show another embodiment of the installation system and method of the present invention. In this embodiment, first and second tandem installation members 210*a* and 210*b* are used to install first and second adjacent sheet pile members 30*a* and 30*b*. The tandem installation members 210*a* and 210*b* are substantially similar to the installation member 10 described above, with the addition of first and second interengaging (for example, male and female profiles in the depicted embodiment) coupling members 215, 217. A first sheet pile member 30*a* is installed using the first tandem installation member 210*a*. Prior to retraction of the first tandem installation member 210*a* from the ground, the second tandem installation member 210*b* (having the second sheet pile member 30*b* carried thereon) is coupled to the first tandem installation member by engagement of the first (male) and second (female) coupling members 215, 217 (FIG. 10 depicts male coupling member 215*a* engaged with female coupling member 217*b*), and the second tandem installation member and second sheet pile member are then driven into the ground alongside first tandem installation member and first sheet pile member, with the male and female lock profiles 36, 38 (FIG. 10 depicts male profile 36*a* engaged with female profile 38*b*) of the sheet pile members engaged. The first tandem installation member 210*a* is then retracted, leaving the first sheet pile member 30*a* in place in the ground, and leaving the second tandem installation member 210*b* and the second sheet pile member 30*b* in place in the ground. The first tandem installation member can then be loaded with another sheet pile member, and the sequence repeated in stepwise fashion. The engagement of the coupling members 215, 217 of the first and second tandem installation members ensures continuous alignment and engagement of the male and female lock profiles of the sheet pile members during installation. Leaving the first tandem installation member in place as the second tandem installation member is driven to grade further prevents buckling and deformation of the sheet pile members, which could lead to separation of the lock profiles.

Figure 13:
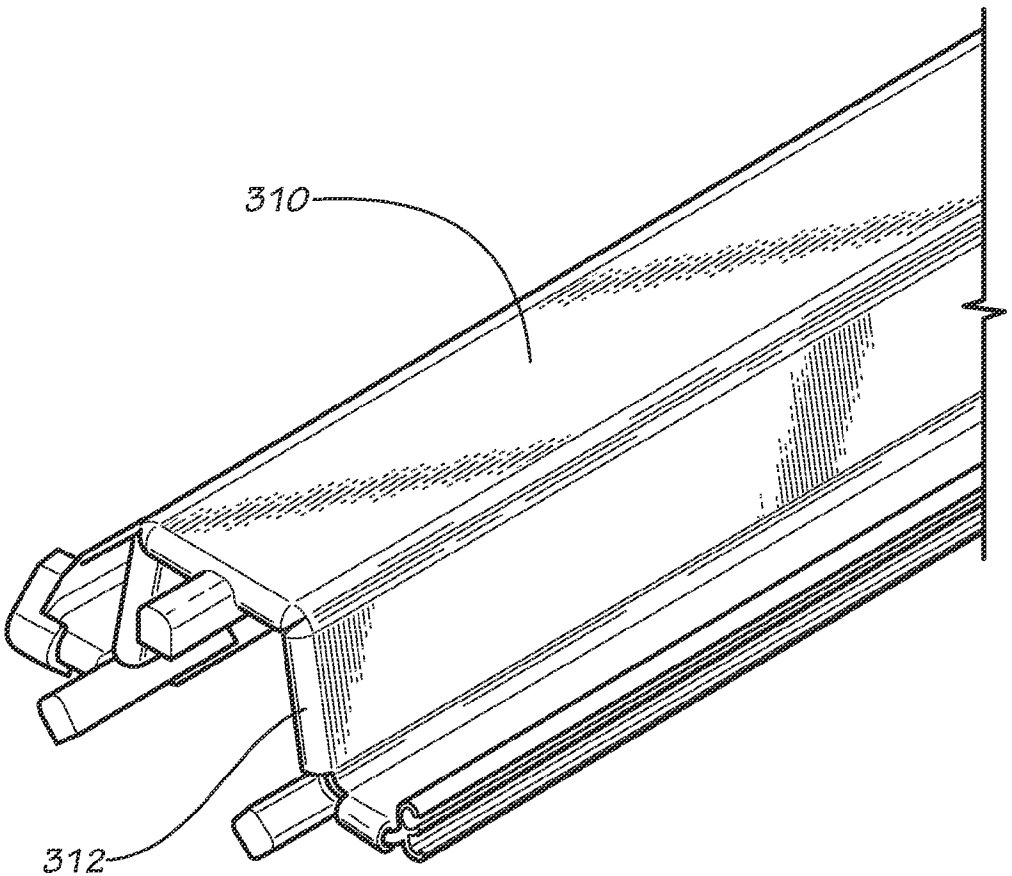
FIG. 13 is a top perspective view of a sheet pile installation system and sheet piling, according to an example form of the present invention.
Figure 14:
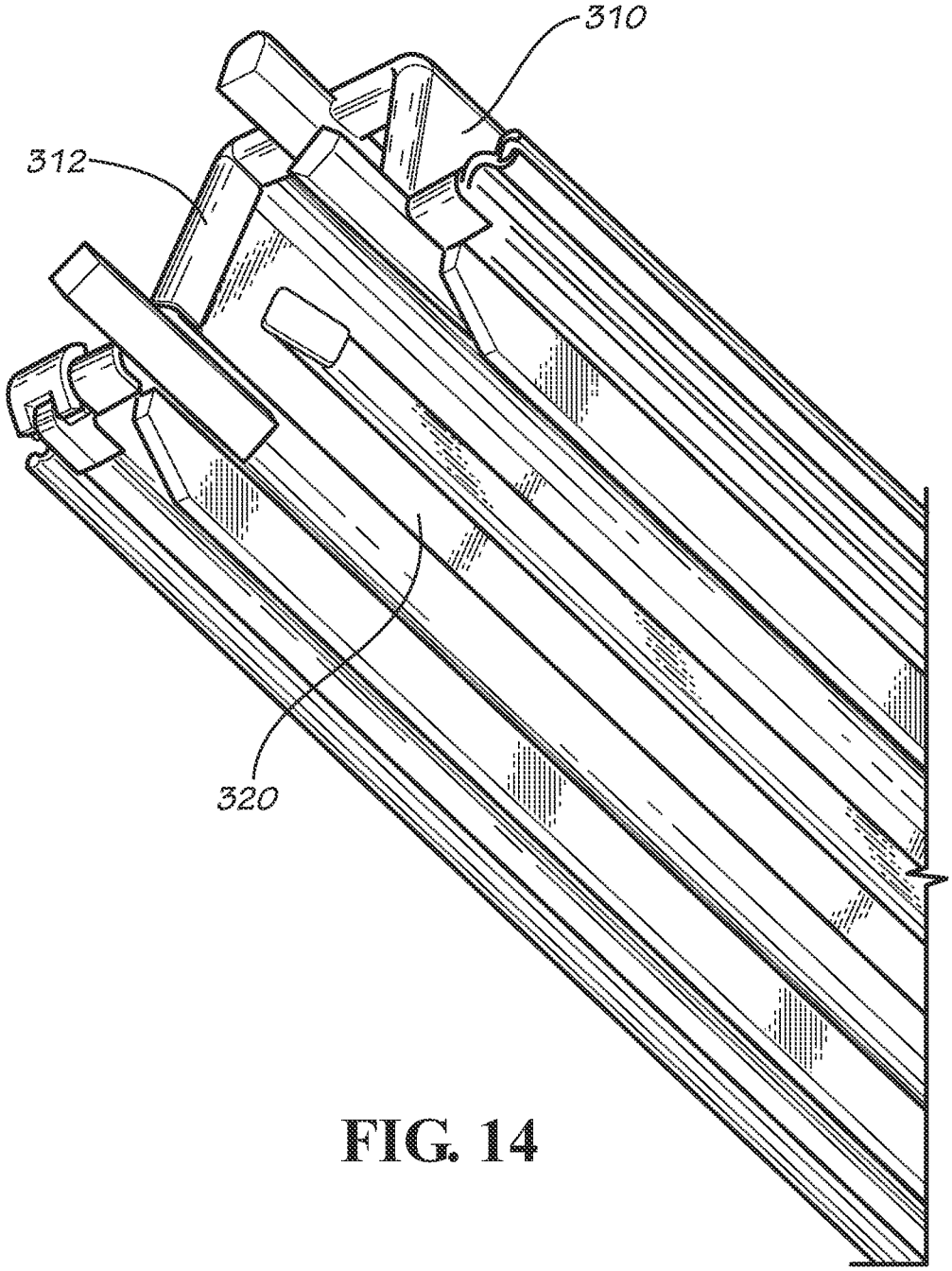
FIG. 14 is a bottom perspective view of the sheet pile installation system of FIG. 13.
Figure 15:
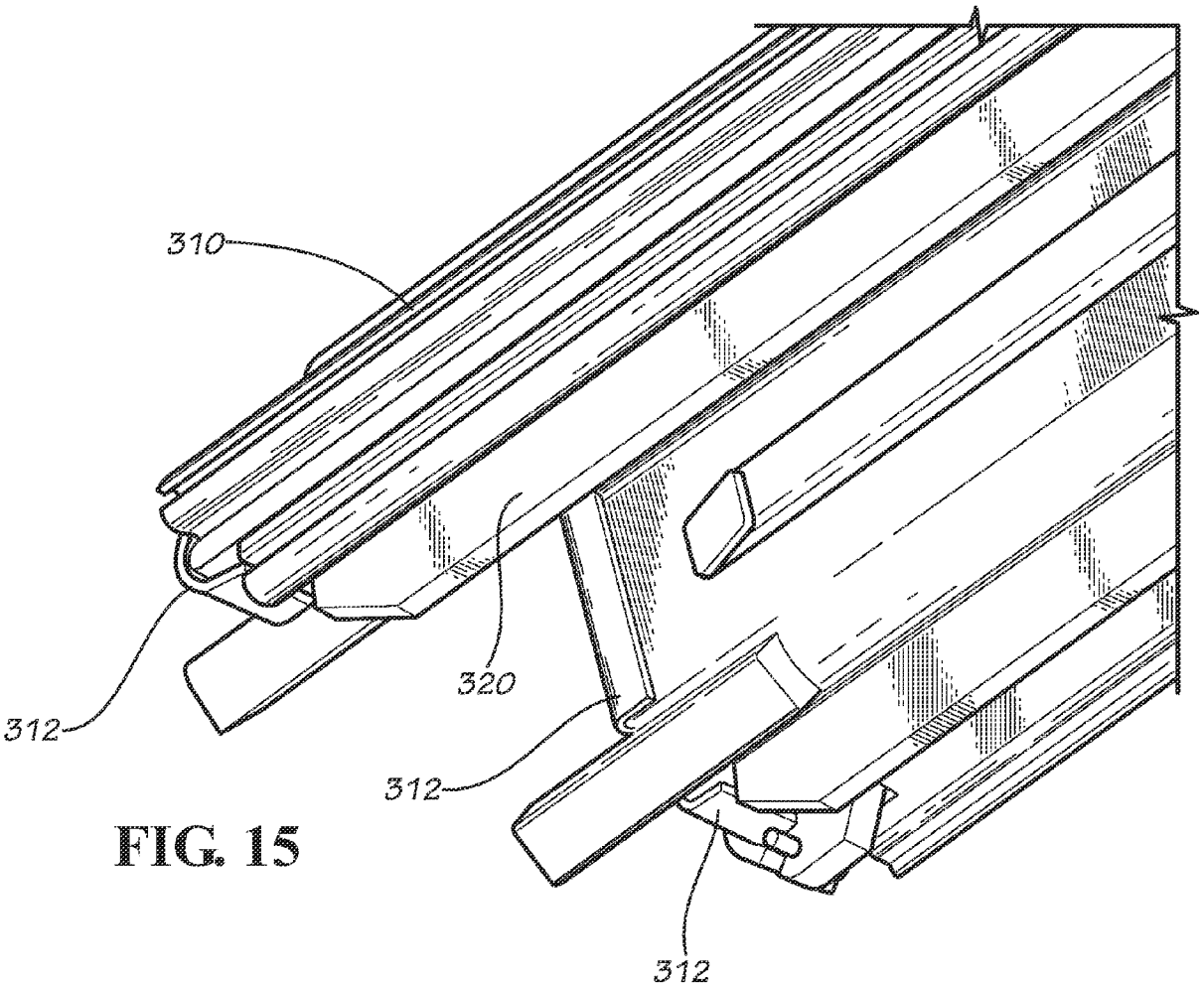
FIG. 15 is another perspective view of the sheet pile installation system of FIG. 13.
Figure 16:
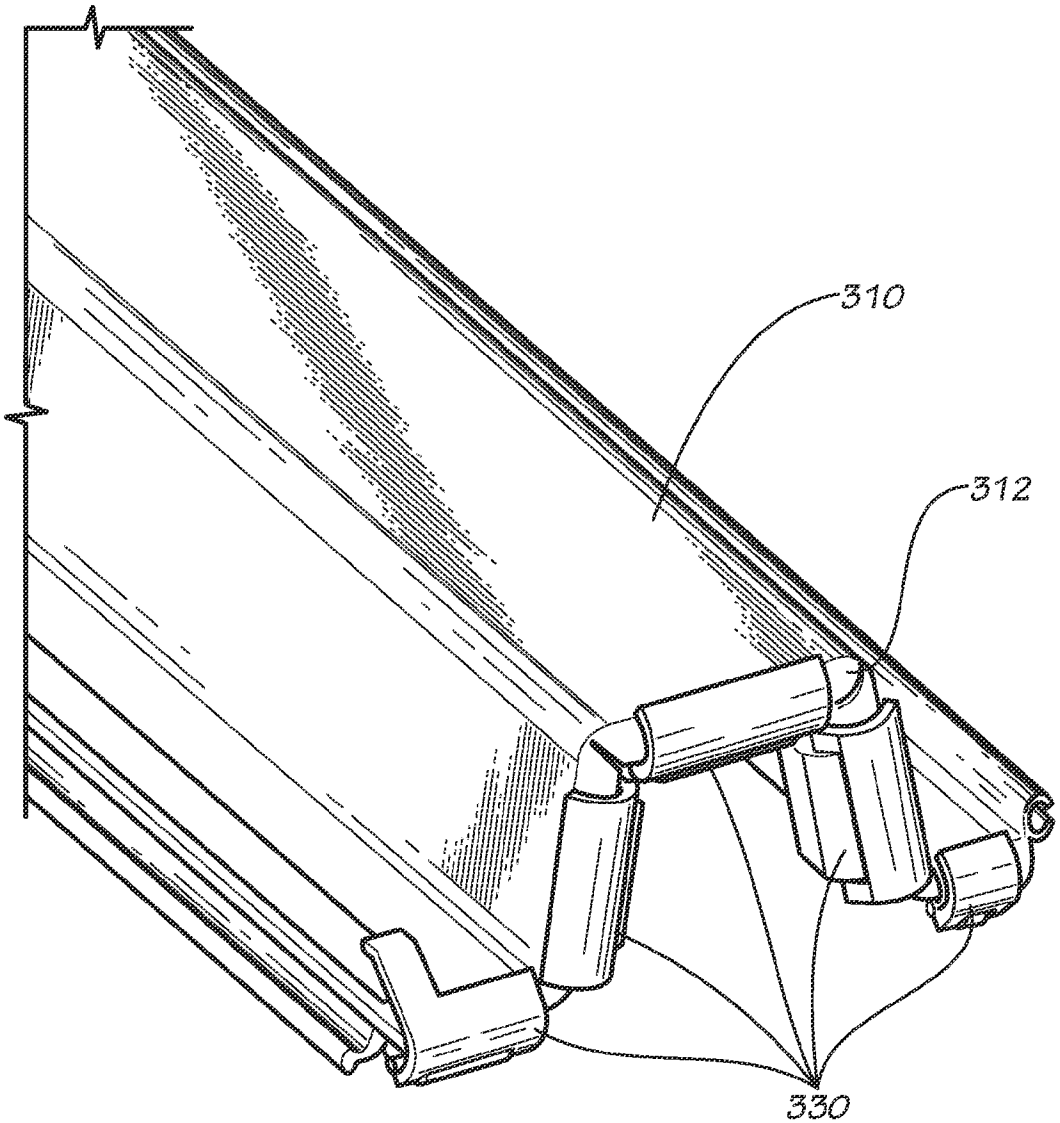
FIG. 16 is a top perspective view of another embodiment of a sheet pile installation system and sheet piling, according to an example form of the present invention.
Figure 17:
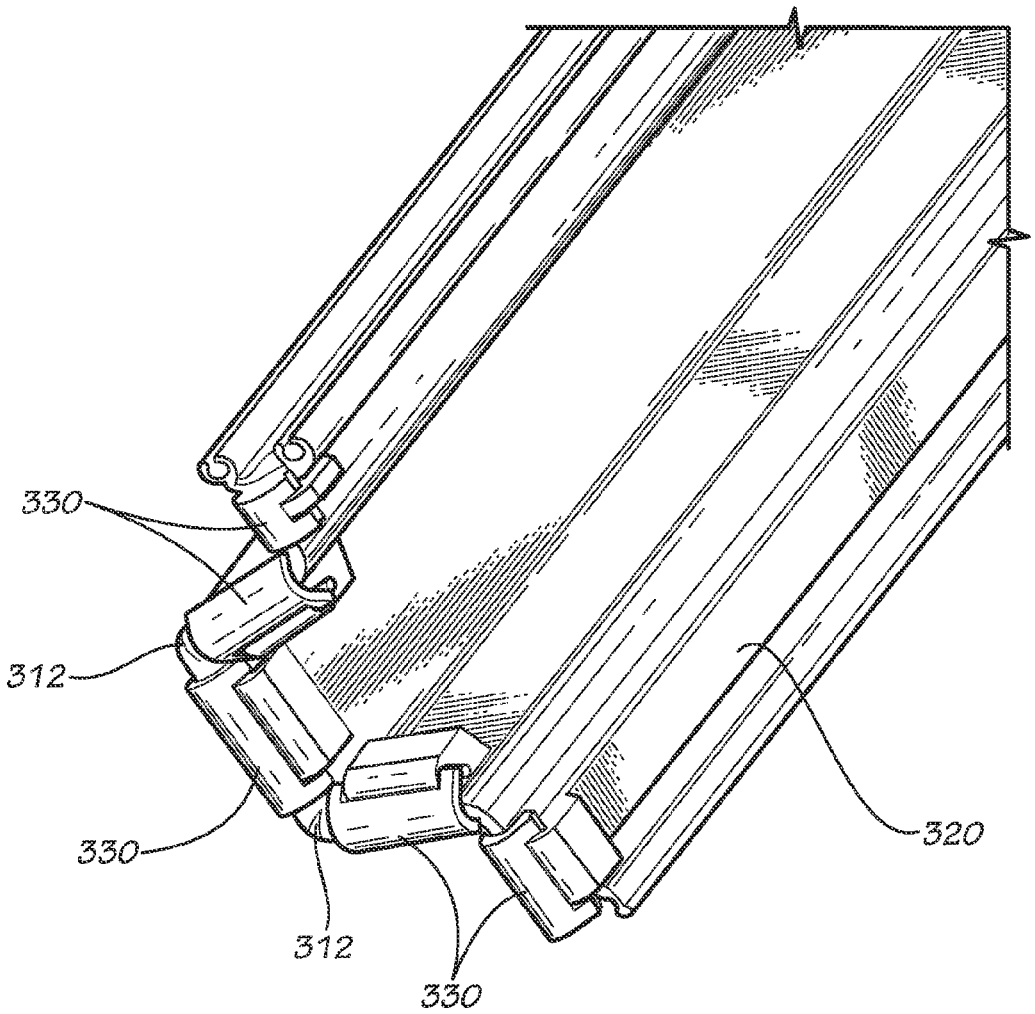
FIG. 17 is a bottom perspective view of the sheet pile installation system and sheet piling of FIG. 16.

FIGS. 13-15 show another example form of the invention, including a sheet piling member 310 with a hooked edge receiver profile 312 extending along at least a portion of its lower end. The hooked receiver profile 312 is configured for engagement over and/or around the lower end of an installation member 320, the lower end or leading edge of the installation member comprising the engagement element of this embodiment. Optionally one or more hinged clamp or shield members 330 are attached to the back of the installation member, as shown in FIGS. 16 and 17, to overlie the hooked receiver profile 312 at the lower end of the sheet piling member 310 when engaged on the engagement element of the installation member to protect and/or grip the receiver profile of the sheet piling member as it is driven into place. Receiver openings through the lower end of the sheet pilings may be omitted, reducing the potential for groundwater migration through the lower reaches of a sheet piling wall. In the depicted embodiment, the hooked receiver profile 312 extends along substantially the entire lower edge of the sheet piling member 310, along each web of its corrugated profile, maximizing the surface contact area in engagement with the engagement element of the installation member and distributing forces as the sheet piling member is pulled into the ground.

Figure 18:
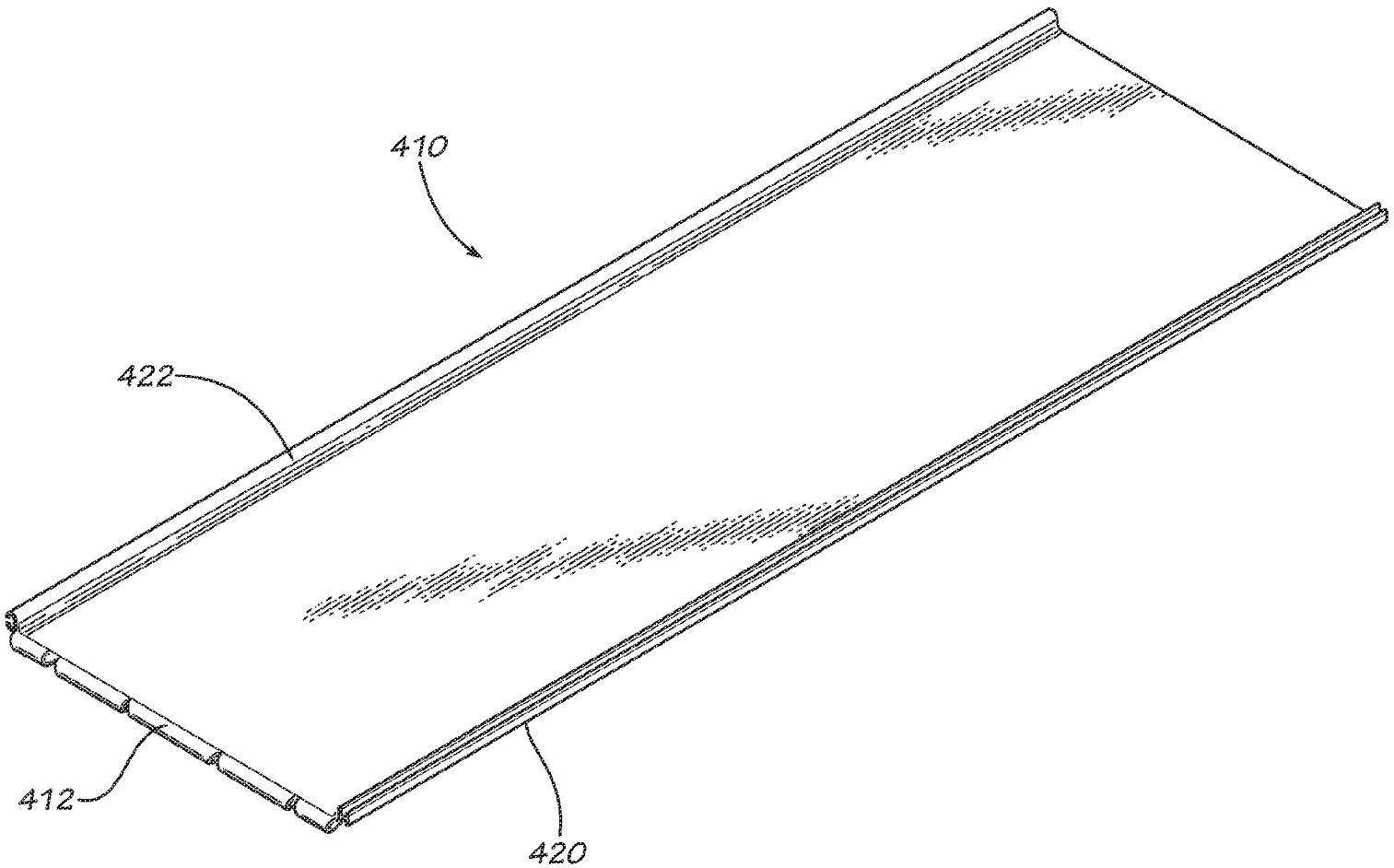
FIG. 18 is perspective view of another embodiment of a sheet pile installation system and sheet piling, according to an example form of the present invention.
Figure 19:
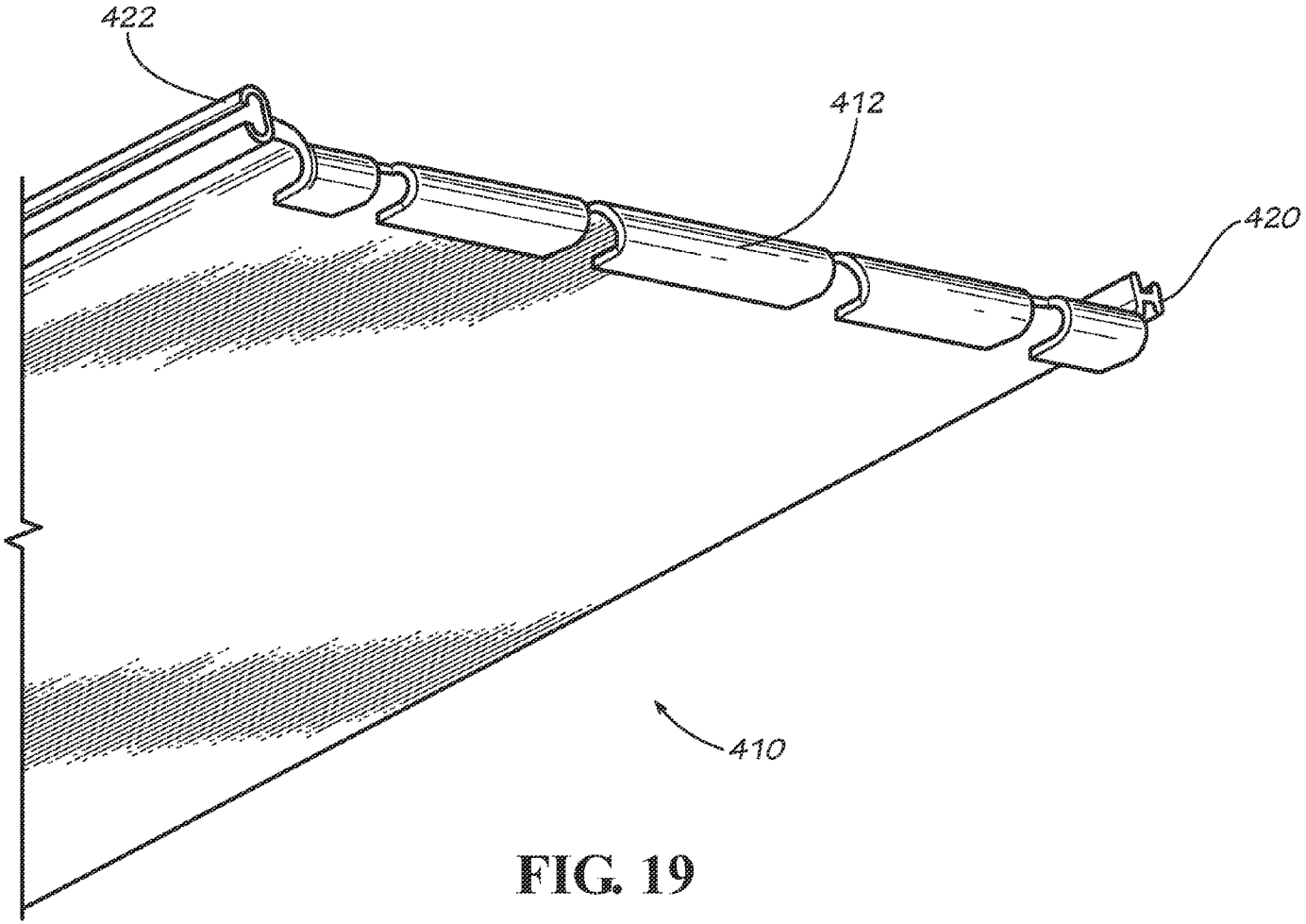
FIG. 19 is a detailed perspective view of the sheet pile installation system and sheet piling of FIG. 18.

FIGS. 18 and 19 show another embodiment of sheet piling 410 according to an example form of the invention. In this embodiment, a hooked receiver profile 412 extends along substantially the entire lower edge of the sheet piling member 410, and first (male in the example embodiment depicted) and second (female in the example embodiment depicted) interengaging coupling members 420, 422 extend along opposite sides of the sheet piling member. The sheet piling member 410 has a substantially flat transverse profile along at least a portion of its length. The sheet piling member can, for example, be formed of vinyl, PVC or other material. In the depicted embodiment, the sheet piling member 410 has a substantially flat transverse profile along substantially all of its length. Because the system and method of the present invention install the sheet piling by pulling it into the ground from its lower end under tension, rather than pushing it into the ground from its upper end under compression, the sheet piling is less susceptible to imposition of buckling forces during installation, thereby eliminating the need for a corrugated transverse cross-sectional profile that resists buckling. By eliminating the need for a corrugated sheet piling profile, the amount of material required for a sheet piling wall of a given span is substantially reduced, thereby reducing cost. Additionally, the material and fabrication costs of a flat installation member are substantially reduced relative to an installation member having a trapezoidal profile configured to match a corrugated sheet piling profile, further reducing costs of use.

In alternate embodiments, the installation member can include one or more gripping members, such as for example a hydraulic or pneumatic clamp for gripping the toe end of the sheet pile to pull the sheet pile into the ground. Alternatively or additionally a vacuum port system of the installation member can apply suction between the installation member and the sheet pile to engage the sheet pile against the installation member as it is driven into the ground, and/or be pressurized to separate the sheet pile from the installation member when the sheet pile has been placed and facilitate removal of the installation member. The engagement and release of the sheet pile with the installation member can be accomplished by various forms of engagement members or systems, with or without the provision of holes or receiver features in the sheet pile, to provide positive retention of the sheet pile at its toe end, and application of tension to the sheet pile upon installation.

The installation apparatus and method of the invention are adaptable for use in installation of various forms of sheet pile components, as well as other forms of elongate barrier members. For example, a wider format installation apparatus (or two or more installation apparatuses operated in combination) may be used to install flexible barrier sheeting or wide-format barrier panels by engagement of one or more receivers adjacent a lower edge of the barrier member by cooperating engagement element(s) of the installation apparatus, and driving the installation apparatus to pull the barrier member into position at a specified depth in the ground.

The present invention also includes the retrofitting of previously known sheet pile installation systems and sheet pilings to include cooperating engagement element(s) and receiver(s), respectively, substantially as described herein, and/or the toe shield, grout tube, male and female coupling members, and/or other features and components of the system and method described herein.

While the invention has been described with reference to preferred and example embodiments, it will be understood by those skilled in the art that a variety of modifications, additions and deletions are within the scope of the invention, as defined by the following claims.

What is claimed is:

1. A barrier installation apparatus comprising:

a substantially rigid elongate beam having an upper end and a lower end;

at least one engagement element proximal the lower end of the substantially rigid elongate beam for releasable engagement with a cooperating receiver of an elongate barrier component, wherein the elongate barrier component is a sheet pile component having an upper end and a lower end, the cooperating receiver being adjacent the lower end of the sheet pile component, and the at least one engagement element engaging the receiver to pull the sheet pile into place under tension.

2. The barrier installation apparatus of claim 1, wherein the at least one engagement element comprises a drive finger projecting from the elongate beam.

3. The barrier installation apparatus of claim 1, further comprising a sacrificial toe shield for attachment to the barrier component.

4. The barrier installation apparatus of claim 1, wherein the substantially rigid elongate beam comprises split lower and upper profile members.

5. A barrier installation apparatus comprising:

a substantially rigid elongate beam having an upper end and a lower end;

at least one engagement element proximal the lower end of the substantially rigid elongate beam for releasable engagement with a cooperating receiver of an elongate barrier component; and at least one hinged toe shield member.

6. The barrier installation apparatus of claim 5, wherein the toe shield member comprises an angularly offset profile for maintaining a spacing approximately equal to a thickness of the sheet pile component at the lower end of the beam and preventing application of upward force on the sheet pile component.

7. The barrier installation apparatus of claim 5, wherein the at least one engagement element comprises a drive finger projecting from the elongate beam.

8. The barrier installation apparatus of claim 5, wherein the substantially rigid elongate beam comprises split lower and upper profile members.

9. A barrier installation apparatus comprising:

a substantially rigid elongate beam having an upper end and a lower end;

at least one engagement element proximal the lower end of the substantially rigid elongate beam for releasable engagement with a cooperating receiver of an elongate barrier component; and a lock protector comprising an inwardly projecting flange extending along a side of the substantially rigid elongate beam.

10. The barrier installation apparatus of claim 9, wherein the at least one engagement element comprises a drive finger projecting from the elongate beam.

11. The barrier installation apparatus of claim 9, further comprising a sacrificial toe shield for attachment to the barrier component.

12. The barrier installation apparatus of claim 9, wherein the substantially rigid elongate beam comprises split lower and upper profile members.

13. A barrier installation apparatus comprising:

a substantially rigid elongate beam having an upper end and a lower end;

at least one engagement element proximal the lower end of the substantially rigid elongate beam for releasable engagement with a cooperating receiver of an elongate barrier component; and a grout delivery tube extending along at least a portion of the length of the substantially rigid elongate beam.

14. The barrier installation apparatus of claim 13, wherein the at least one engagement element comprises a drive finger projecting from the elongate beam.

15. The barrier installation apparatus of claim 13, further comprising a sacrificial toe shield for attachment to the barrier component.

16. The barrier installation apparatus of claim 13, wherein the substantially rigid elongate beam comprises split lower and upper profile members.

17. A barrier installation apparatus comprising:

a substantially rigid elongate beam having an upper end and a lower end;

at least one engagement element proximal the lower end of the substantially rigid elongate beam for releasable engagement with a cooperating receiver of an elongate barrier component, wherein the substantially rigid elongate beam comprises a first interengaging coupling member along a first side thereof and a second interengaging coupling member along a second side thereof.

18. The barrier installation apparatus of claim 17, wherein the at least one engagement element comprises a drive finger projecting from the elongate beam.

19. The barrier installation apparatus of claim 17, further comprising a sacrificial toe shield for attachment to the barrier component.

20. The barrier installation apparatus of claim 17, wherein the substantially rigid elongate beam comprises split lower and upper profile members.

21. A system for installation of elongate members, said system comprising:

an installation apparatus comprising a substantially rigid elongate beam having an upper end and a lower end, and at least one engagement element proximal the lower end of the substantially rigid elongate beam; and an elongate member having an upper end and a lower end, and a first side and a second side, the first side comprising a first interengaging profile lock and the second side comprising a second interengaging profile lock, the elongate member further comprising at least one receiver proximal the lower end for receiving the at least one engagement element of the elongate member installation apparatus.

22. The system of claim 21, wherein the installation apparatus comprises first and second tandem installation members.

23. A system for installing elongate barrier members in the ground, comprising an installation member and an elongate barrier member, the elongate barrier member having at least one receiver proximal a lower end thereof for releasable engagement with the installation member to install the elongate member under tension, wherein the installation member is released from engagement with the receiver of the elongate barrier member after installation is complete to allow retraction of the installation member.

24. The system of claim 23, wherein the at least one receiver comprises a hooked profile along at least a portion of a lower edge of the elongate barrier member.

* * * * *